US011340031B1

(12) United States Patent
Chen

(10) Patent No.: US 11,340,031 B1
(45) Date of Patent: May 24, 2022

(54) BULLET DROP PREVENTION MECHANISM AND BULLET LOADER

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 17/489,852

(22) Filed: Sep. 30, 2021

(30) Foreign Application Priority Data

Mar. 25, 2021 (CN) ..... 202120640367.5

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82
See application file for complete search history.

(56) References Cited

U.S. PATENT DOCUMENTS

2020/0182570 A1* 6/2020 Bian ..... F41A 9/83

* cited by examiner

*Primary Examiner* — J. Woodrow Eldred

(57) ABSTRACT

The utility model discloses a bullet drop prevention mechanism. The bullet drop prevention mechanism is movably connected with a bullet loader and includes a blocking part. A bullet head on the uppermost portion of a magazine located inside the bullet loader is blocked by the blocking part. The utility model also discloses the bullet loader including the bullet drop prevention mechanism described above. According to the bullet drop prevention mechanism, the problem that the uppermost bullet in a traditional bullet loader may drop out of the magazine is solved, not only loading of a bullet is not hindered, but also existing space of a traditional bullet loader is utilized, and no extra space is needed for installation.

12 Claims, 6 Drawing Sheets

BULLET DROP PREVENTION MECHANISM AND BULLET LOADER

TECHNICAL FIELD

The utility model relates to a bullet loader with a bullet drop prevention mechanism.

BACKGROUND ART

Chinese invention patent application with the publication No. CN111006542A discloses a bullet loader with inner and outer sleeves. An external bullet is loaded into a magazine through the relative movement between the inner sleeve and the outer sleeve and a guide arm. After the bullet is loaded into the magazine, the bullet may be taken out of the magazine again when the guide arm exits from the magazine.

SUMMARY OF THE INVENTION

The technical problem to be solved by the utility model is to provide a bullet drop prevention mechanism and a bullet loader including the same, so as to overcome the defect that the bullet may drop out of the magazine in the prior art.

The technical solution adopted by the utility model to solve the above technical problem is:

a bullet drop prevention mechanism. The bullet drop prevention mechanism is movably connected with the bullet loader and includes a blocking part, and a bullet head on the uppermost portion of a magazine located inside the bullet loader is blocked by the blocking part.

Further, the bullet drop prevention mechanism is rotationally connected with the bullet loader.

The utility model also provides a bullet loader with the bullet drop prevention mechanism described above.

Further, the bullet loader includes a position limit mechanism used for limiting the movement range of the bullet drop prevention mechanism.

Further, the bullet loader includes an outer sleeve and an inner sleeve, the outer sleeve is slidably connected with the inner sleeve, and the outer sleeve is rotationally connected with the bullet drop prevention mechanism.

Further, the position limit mechanism includes an upper limit part and a lower limit part located on the outer sleeve.

Further, the blocking part has a limiting block matching with the lower limit part.

Further, the bullet loader has a guide mechanism, and the guide mechanism is rotationally connected with the outer sleeve.

Further, the guide mechanism includes a guide arm, the blocking part has an opening, and the opening allows the tail end of the guide arm to pass through the blocking part without hindrance during its own swing.

Further, the blocking part has a curved surface, and the curved surface is in line contact with the edge of an opening in the upper end of the inner sleeve.

Compared with the prior art, the utility model has the advantages that: the bullet drop prevention mechanism solves the problem that the uppermost bullet in a traditional bullet loader may drop out of the magazine, not only loading of the bullet is not hindered, but also existing space of a traditional bullet loader is utilized, and no extra space is needed for installation.

DETAILED DESCRIPTION OF THE INVENTION

The utility model is further described in detail below in combination with the drawings and the embodiments.

Figure 1:
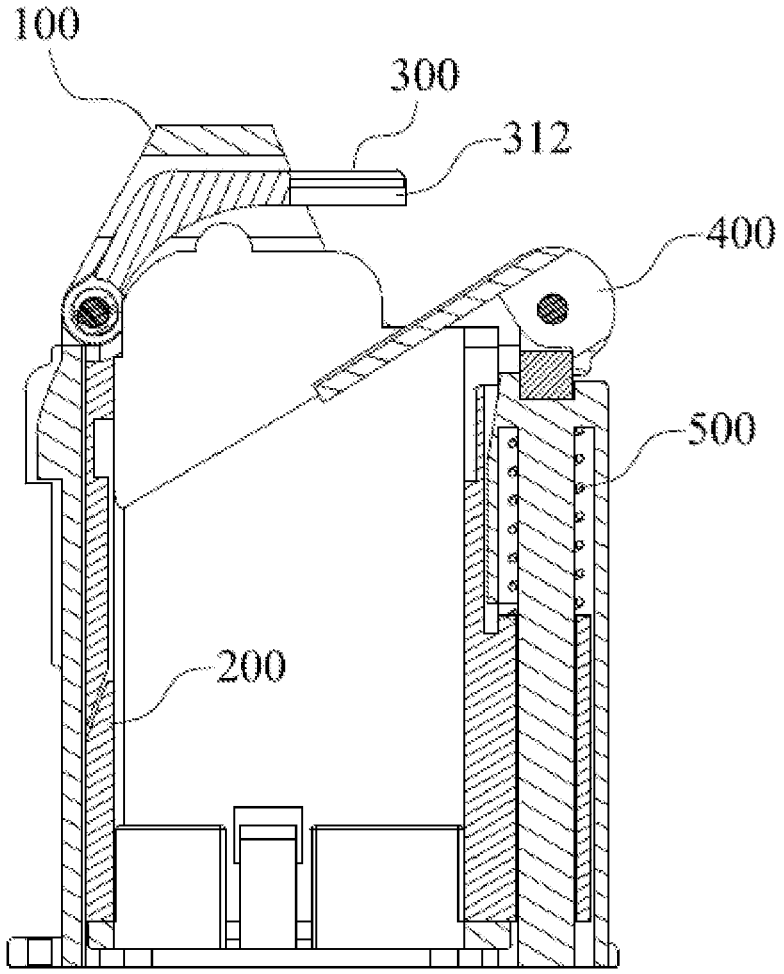
FIG. 1 is a schematic diagram of the sectional structure of a bullet loader of the utility model.
Figure 2:
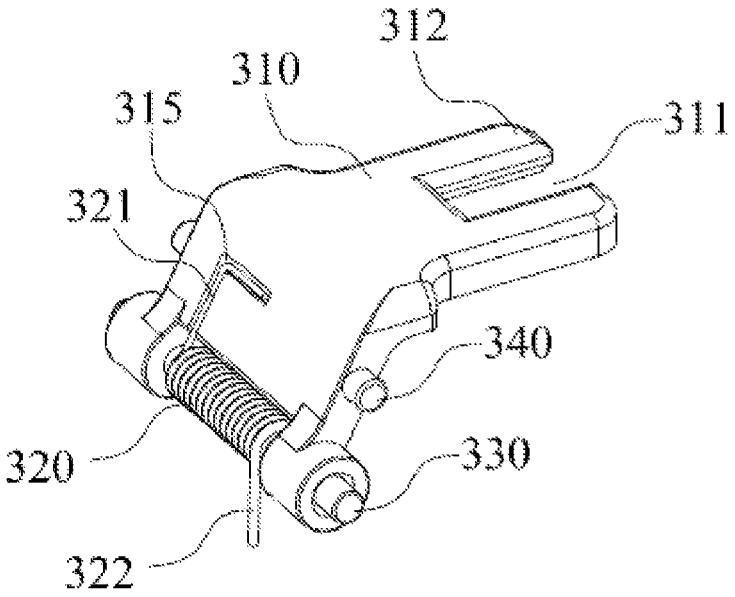
FIG. 2 is a schematic diagram of the overall structure of a bullet drop prevention mechanism of the utility model.
Figure 3:
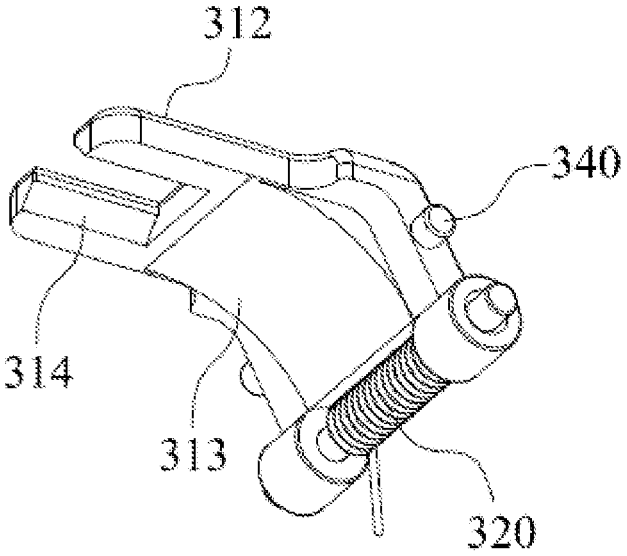
FIG. 3 is a schematic diagram of the overall structure of a bullet drop prevention mechanism of the utility model from another angle.
Figure 4:
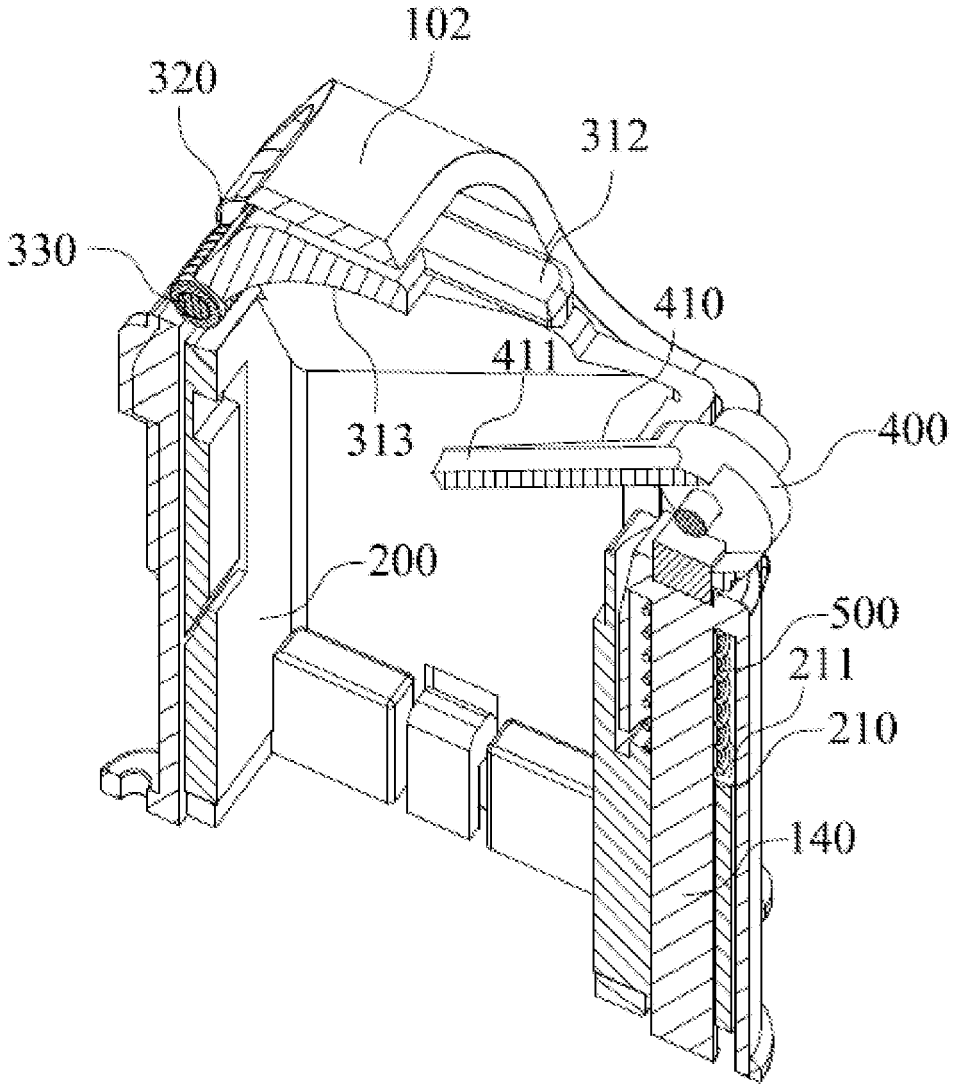
FIG. 4 is a schematic diagram of the sectional structure of the bullet loader of the utility model from another angle.
Figure 5:
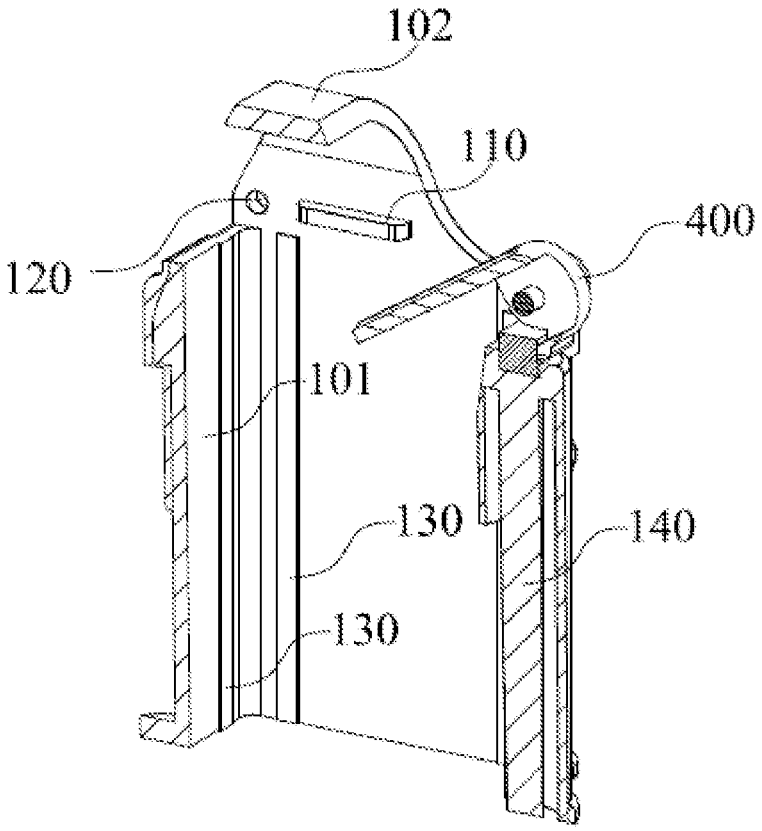
FIG. 5 is a schematic diagram of the sectional structure of an outer sleeve and a guide arm of the bullet loader of the utility model.
Figure 6:
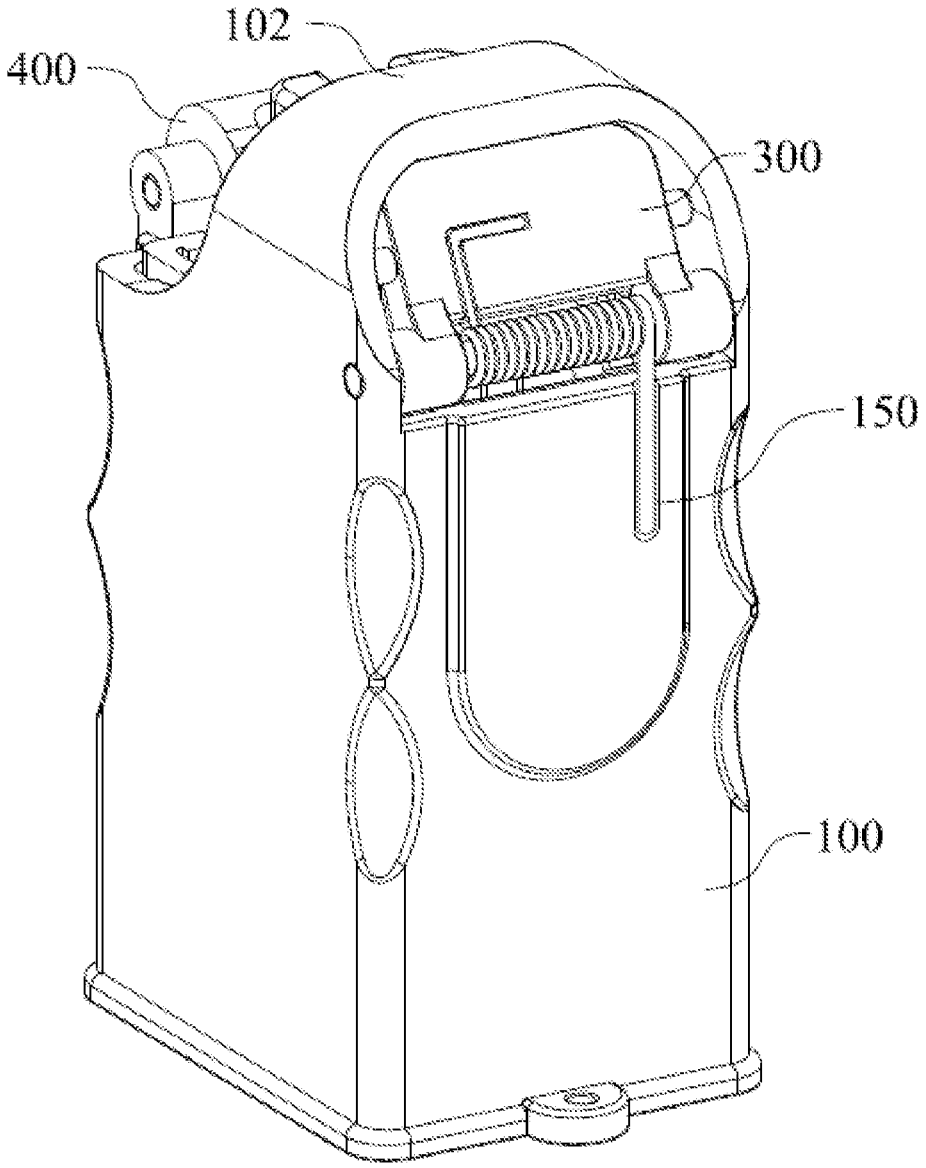
FIG. 6 is a schematic diagram of the overall structure of the bullet loader of the utility model.

By reference to FIGS. 1-6, the bullet loader of the utility model includes an outer sleeve 100 and an inner sleeve 200. The outer sleeve 100 is movably connected with the inner sleeve 200. In one embodiment, the outer sleeve 100 is slidably connected with the inner sleeve 200 in the axial direction. A cavity of the inner sleeve 200 is used for accommodating a magazine where a bullet needs to be loaded. When the magazine is installed into the bullet loader, the inner sleeve 200 and the magazine generally maintain a relatively stable state. An opening in the upper end of the bullet loader has a guide mechanism 400 used for leading the bullet into the magazine located inside the bullet loader. The guide mechanism 400 is connected with the outer sleeve 100, and the guide mechanism 400 includes a guide arm 410. The guide arm 410 is rotationally connected with the outer sleeve 100. In one embodiment, the guide arm 410 is rotationally connected with the outer sleeve 100 through a reset torsion spring (not shown in the figures). When being subjected to the thrust of the pushed bullet, the guide arm 410 rotates downward and approaches the inner side wall of the inner sleeve 200. After the bullet enters the magazine, the outer sleeve 100 moves upward to drive the guide arm 410 to continue to rotate downward. After the guide arm 410 is separated from the bullet, the guide arm 410 starts to rotate upward under the action of the reset torsion spring at the moment of separating from the bullet, until it returns to the original position. In one embodiment, the guide arm 410 has a guide surface 411, and the guide surface 411 is a curved surface matching with the outer surface of the bullet, in order to lead the bullet to quickly enter the magazine.

The bullet drop prevention mechanism 300 is movably connected or rotationally connected with the outer sleeve 100. The bullet drop prevention mechanism 300 has a blocking part 310. When the bullet enters the magazine, the blocking part 310 is located in front of the bullet head. When the outer sleeve 100 drives the guide arm 410 to be away from the bullet, the blocking part 310 plays a role in blocking in front of the bullet head all the time, until the guide arm 410 is reset to be located above the loaded bullet. In one embodiment, the blocking part 310 has an opening 311, the opening 311 allows the tail end of the guide arm 410 to pass through the blocking part 310 without hindrance during its own swing, which includes allowing the tail end of the guide arm to pass through the blocking part 310 without hindrance in the process of pressing down the loaded bullet and in the process of being driven by the outer sleeve 100 to separate from the bullet. In one embodiment, the horizontal maximum width of the guide arm 410 is smaller than the diameter of the bullet, correspondingly the maximum width of the opening 311 is also smaller than the diameter of the bullet, but the maximum width of the opening 311 should be slightly larger than the horizontal maximum width of the guide arm 410. In one embodiment, a pair of symmetrical arms 312 are formed on two sides of the opening 311, and the surfaces 314, contacting with the bullet, of the arms 312 are curved surfaces matching with the outer surface of the bullet to increase the contact area of the arms 312 and the outer surface of the bullet. In one embodiment, the blocking part 310 has a curved surface 313. When the outer sleeve 100 drives the guide arm 410 to press down the bullet, the curved surface 313 is in line contact with the edge of an opening in the upper end of the inner sleeve 200 to reduce frictional force generated when the blocking part 310 and the inner sleeve 200 relatively move.

In one embodiment, the bullet drop prevention mechanism 300 is rotationally connected with the outer sleeve 100 through a rotating shaft 330 and a torsion spring 320, and the rotating shaft 330 passes through the torsion spring 320 and a pair of symmetrical connecting holes 120 in the outer sleeve 100. The torsion spring 320 has a first arm 321 and a second arm 322. The first arm 321 is located in a first groove 315 of the bullet drop prevention mechanism 300, and the second arm 322 is located in a second groove 150 of the outer sleeve 100. The bullet drop prevention mechanism 300 always has a tendency to move close to the inner wall 101 of the outer sleeve 100. In other embodiments, the bullet drop prevention mechanism 300 may also be movably connected with the outer sleeve 100 through a spring or other elastic connectors.

The outer sleeve 100 has a position limit mechanism used for limiting the movement range of the bullet drop prevention mechanism 300, and the position limit mechanism includes an upper limit part 102 and a lower limit part 110. In one embodiment, the upper limit part 102 is a bridge located on the upper portion of the outer sleeve 100. In one embodiment, the lower limit part 110 refers to a protrusion symmetrically located on the inner wall of the outer sleeve 100, and the protrusion matches with the limit blocks 340 on two sides of the bullet drop prevention mechanism 300 to achieve a limit effect.

The inner wall 101 of the outer sleeve 100 also has a guide bar 130 used for matching with the inner sleeve 200 to achieve a stable sliding connection.

The inner sleeve 200 has a hole 210, and the outer sleeve 100 has a pillar 140. The pillar 140 passes through the spring 500 and penetrates into the hole 210. The hole 210 has a limit surface 211. One end of the spring 500 abuts against the limit surface 211, and the other end of the spring abuts against the junction of the pillar 140 and the outer sleeve 100. The spring 500 is in a compressed state when the outer sleeve 100 and the inner sleeve 200 are close to each other.

What is claimed is:

1. A bullet drop prevention mechanism, wherein the bullet drop prevention mechanism is applied to a bullet loader, and the bullet drop prevention mechanism includes a blocking part used for blocking a bullet head on the uppermost portion of a magazine located inside the bullet loader wherein the bullet drop prevention mechanism is rotationally installed on the bullet loader.

2. The bullet drop prevention mechanism according to claim 1, wherein the bullet drop prevention mechanism is movably installed on the bullet loader.

3. A bullet loader, comprising a bullet drop prevention mechanism, wherein the bullet drop prevention mechanism includes a blocking part used for blocking a bullet head on the uppermost portion of a magazine located inside the bullet loader;

wherein the bullet loader further comprises an outer sleeve, an inner sleeve, and a guide mechanism, the outer sleeve is slidably connected with the inner sleeve, the inner sleeve is used for accommodating the magazine, and the outer sleeve is connected with the bullet drop prevention mechanism; the guide mechanism is rotationally connected with the outer sleeve, and the guide mechanism is used for leading the bullet to enter the magazine located inside the bullet loader.

4. The bullet loader according to claim 3, wherein the guide mechanism includes a guide arm, the blocking part has an opening, and the opening allows the tail end of the guide arm to pass through the blocking part without hindrance during its own swing.

5. The bullet loader according to claim 4, wherein the width of the opening is smaller than the diameter of the bullet, and the width of the opening is larger than the width of the guide arm.

6. The bullet loader according to claim 5, wherein the blocking part has a pair of symmetrical arms on two sides of the opening, and the surface, used for contacting with the bullet, of each arm is a curved surface matching with the outer surface of the bullet.

7. The bullet loader according to claim 3, wherein the bullet drop prevention mechanism is movably connected with the outer sleeve.

8. The bullet loader according to claim 3, wherein the bullet loader also includes a position limit mechanism used for limiting the movement range of the bullet drop prevention mechanism.

9. The bullet loader according to claim 8, wherein the position limit mechanism includes an upper limit part and a lower limit part located on the outer sleeve, and the upper limit part and the lower limit part are located on two sides of the blocking part.

10. The bullet loader according to claim 9, wherein the blocking part has a limit block matching with the upper limit part and the lower limit part.

11. The bullet loader according to claim 3, wherein the blocking part has a curved surface, and the curved surface is in line contact with the edge of an opening in the upper end of the inner sleeve.

12. A bullet loader, comprising a bullet drop prevention mechanism; wherein the bullet drop prevention mechanism comprises a blocking part used for blocking a bullet head on the uppermost portion of a magazine located inside the bullet loader; wherein the bullet loader further comprises an outer sleeve and an inner sleeve; the outer sleeve is slidably connected with the inner sleeve, the inner sleeve is used for accommodating the magazine, the bullet drop prevention mechanism is rotationally connected with the outer sleeve.

* * * * *